US009278321B2

(12) United States Patent
Dale et al.

(10) Patent No.: US 9,278,321 B2
(45) Date of Patent: Mar. 8, 2016

(54) CHIP AND CARTRIDGE DESIGN CONFIGURATION FOR PERFORMING MICRO-FLUIDIC ASSAYS

(75) Inventors: Gregory A. Dale, Gaithersburg, MD (US); Ivor T. Knight, Arlington, VA (US)

(73) Assignee: Canon U.S. Life Sciences, Inc., Rockville, MD (US)

( * ) Notice: Subject to any disclaimer, the term of this patent is extended or adjusted under 35 U.S.C. 154(b) by 713 days.

(21) Appl. No.: 11/850,229

(22) Filed: Sep. 5, 2007

(65) Prior Publication Data

US 2008/0056948 A1 Mar. 6, 2008

Related U.S. Application Data

(60) Provisional application No. 60/824,654, filed on Sep. 6, 2006.

(51) Int. Cl.
*B01F 5/06* (2006.01)
*B01L 3/00* (2006.01)
(Continued)

(52) U.S. Cl.
CPC ..... *B01F 5/0647* (2013.01); *B01L 3/502715* (2013.01); *B01F 5/0602* (2013.01); *B01F 13/0059* (2013.01); *B01L 7/52* (2013.01); *B01L 2200/027* (2013.01); *B01L 2200/04* (2013.01); *B01L 2200/0668* (2013.01); *B01L 2200/16* (2013.01); *B01L 2300/087* (2013.01); *B01L 2300/0829* (2013.01)

(58) Field of Classification Search
CPC ..... B01L 2300/0816; B01L 2200/027; B01L 2400/0487; B01L 3/502715; B01L 3/5027; B01L 9/527; B01L 2200/10; B01L 2300/0636; B01L 2300/0867; B01L 3/5025; B01L 2200/0605; B01L 2300/0819; B01L 2200/00
See application file for complete search history.

(56) References Cited

U.S. PATENT DOCUMENTS 6,331,439 B1 12/2001 Cherukuri et al.
6,374,684 B1 4/2002 Dority
(Continued)

FOREIGN PATENT DOCUMENTS

JP 2001-521622 A 11/2001
JP 2004-163427 A 6/2004
(Continued)

OTHER PUBLICATIONS

Liu et al., "Integrated microfluidic biochips for DNA microarray analysis," Expert Review of Molecular Diagnositcs, vol. 6, No. 2, pp. 253-261 (2006) (abstract).

*Primary Examiner* — Sally Merkling
(74) *Attorney, Agent, or Firm* — Rothwell, Figg, Ernst & Manbeck, P.C.

(57) ABSTRACT

An assembly for performing micro-fluidic assays includes a micro-fluidic chip with access ports and micro-channels in communication with the access ports and a fluid cartridge having internal, fluid-containable chambers and a nozzle associated with each internal chamber that is configured to be coupled with an access port. Reaction fluids, such as sample material, buffer, and/or reagent, contained within the cartridge are dispensed from the cartridge into the access ports and micro-channels of the micro-fluidic chip. Embodiments of the invention include a cartridge which includes a waste compartment for receiving used DNA and other reaction fluids from the micro-channel at the conclusion of the assay.

15 Claims, 9 Drawing Sheets

(51) Int. Cl.
*B01F 13/00* (2006.01)
*B01L 7/00* (2006.01)

(56) References Cited

U.S. PATENT DOCUMENTS

| | | | | |
|---|---|---|---|---|
| 6,729,196 | B2 | 5/2004 | Moler et al. | |
| 6,811,668 | B1 | 11/2004 | Berndt et al. | |
| 6,919,045 | B1 * | 7/2005 | Berndt | 422/100 |
| 6,951,147 | B2 | 10/2005 | Call et al. | |
| 6,977,163 | B1 * | 12/2005 | Mehta | 435/91.2 |
| 2001/0029793 | A1 | 10/2001 | Moler et al. | |
| 2002/0025582 | A1 | 2/2002 | Hubbard et al. | |
| 2003/0087309 | A1 | 5/2003 | Chen | |
| 2003/0148922 | A1 | 8/2003 | Knapp et al. | |
| 2003/0230488 | A1 | 12/2003 | Lee et al. | |
| 2004/0053290 | A1 * | 3/2004 | Terbrueggen et al. | 435/6 |
| 2004/0189311 | A1 | 9/2004 | Glezer et al. | |
| 2004/0202581 | A1 | 10/2004 | Berndt | |
| 2005/0011764 | A1 | 1/2005 | Berndt et al. | |
| 2005/0019875 | A1 | 1/2005 | Chen | |
| 2007/0026426 | A1 | 2/2007 | Fuernkranz et al. | |
| 2007/0048194 | A1 | 3/2007 | Schulein et al. | |

FOREIGN PATENT DOCUMENTS

| | | | |
|---|---|---|---|
| JP | 2005-10161 | A | 1/2005 |
| JP | 2006-517652 | A | 7/2006 |
| WO | 00/26657 | A1 | 5/2000 |
| WO | 2005/047855 | A2 | 5/2005 |

* cited by examiner

CHIP AND CARTRIDGE DESIGN CONFIGURATION FOR PERFORMING MICRO-FLUIDIC ASSAYS

CROSS REFERENCE OF RELATED APPLICATION

This application claims priority to U.S. provisional application Ser. No. 60/824,654, filed Sep. 6, 2006, which is incorporated herein by reference.

FIELD OF THE INVENTION

This invention relates to vessels for performing micro-fluidic assays. More specifically, the invention relates to a cartridge for containing sample materials, and, optionally, assay reagents, buffers, and waste materials, and which may be coupled to a micro-fluidic chip having micro-channels within which assays, such as real-time polymerase chain reaction, are performed on sample material carried within the cartridge.

BACKGROUND OF INVENTION

The detection of nucleic acids is central to medicine, forensic science, industrial processing, crop and animal breeding, and many other fields. The ability to detect disease conditions (e.g., cancer), infectious organisms (e.g., HIV), genetic lineage, genetic markers, and the like, is ubiquitous technology for disease diagnosis and prognosis, marker assisted selection, correct identification of crime scene features, the ability to propagate industrial organisms and many other techniques. Determination of the integrity of a nucleic acid of interest can be relevant to the pathology of an infection or cancer. One of the most powerful and basic technologies to detect small quantities of nucleic acids is to replicate some or all of a nucleic acid sequence many times, and then analyze the amplification products. Polymerase chain reaction ("PCR") is perhaps the most well-known of a number of different amplification techniques.

PCR is a powerful technique for amplifying short sections of DNA. With PCR, one can quickly produce millions of copies of DNA starting from a single template DNA molecule. PCR includes a three phase temperature cycle of denaturation of DNA into single strands, annealing of primers to the denatured strands, and extension of the primers by a thermostable DNA polymerase enzyme. This cycle is repeated so that there are enough copies to be detected and analyzed. In principle, each cycle of PCR could double the number of copies. In practice, the multiplication achieved after each cycle is always less than 2. Furthermore, as PCR cycling continues, the buildup of amplified DNA products eventually ceases as the concentrations of required reactants diminish. For general details concerning PCR, see Sambrook and Russell, *Molecular Cloning—A Laboratory Manual* (3rd Ed.), Vols. 1-3, Cold Spring Harbor Laboratory, Cold Spring Harbor, N.Y. (2000); *Current Protocols in Molecular Biology*, F. M. Ausubel et al., eds., Current Protocols, a joint venture between Greene Publishing Associates, Inc. and John Wiley & Sons, Inc., (supplemented through 2005) and *PCR Protocols A Guide to Methods and Applications*, M. A. Innis et al., eds., Academic Press Inc. San Diego, Calif. (1990).

Real-time PCR refers to a growing set of techniques in which one measures the buildup of amplified DNA products as the reaction progresses, typically once per PCR cycle. Monitoring the accumulation of products over time allows one to determine the efficiency of the reaction, as well as to estimate the initial concentration of DNA template molecules. For general details concerning real-time PCR see *Real-Time PCR: An Essential Guide*, K. Edwards et al., eds., Horizon Bioscience, Norwich, U.K. (2004).

Several different real-time detection chemistries now exist to indicate the presence of amplified DNA. Most of these depend upon fluorescence indicators that change properties as a result of the PCR process. Among these detection chemistries are DNA binding dyes (such as SYBR® Green) that increase fluorescence efficiency upon binding to double stranded DNA. Other real-time detection chemistries utilize Foerster resonance energy transfer (FRET), a phenomenon by which the fluorescence efficiency of a dye is strongly dependent on its proximity to another light absorbing moiety or quencher. These dyes and quenchers are typically attached to a DNA sequence-specific probe or primer. Among the FRET-based detection chemistries are hydrolysis probes and conformation probes. Hydrolysis probes (such as the TaqMan probe) use the polymerase enzyme to cleave a reporter dye molecule from a quencher dye molecule attached to an oligonucleotide probe. Conformation probes (such as molecular beacons) utilize a dye attached to an oligonucleotide, whose fluorescence emission changes upon the conformational change of the oligonucleotide hybridizing to the target DNA.

Commonly-assigned, co-pending U.S. application Ser. No. 11/505,358, entitled "Real-Time PCR in Micro-Channels," the disclosure of which is hereby incorporated by reference, describes a process for performing PCR within discrete droplets flowing through a micro-channel and separated from one another by droplets of non-reacting fluids, such as buffer solution, known as flow markers.

Devices for performing in-line assays, such as PCR, within micro-channels include micro-fluidic chips having one or more micro-channels formed within the chip are known in the art. These chips utilize a sample sipper tube and open ports on the chip topside to receive and deliver reagents and sample material (e.g., DNA) to the micro-channels within the chip. The chip platform is designed to receive reagents at the open ports—typically dispensed by a pipetter—on the chip top, and reagent flows from the open port into the micro-channels, typically under the influence of a vacuum applied at an opposite end of each micro-channel. The DNA sample is supplied to the micro-channel from the wells of a micro-well plate via the sipper tube, which extends below the chip and through which sample material is drawn from the wells due to the vacuum applied to the micro-channel.

This open design is susceptible to contamination—both cross-over between samples and assays and exposure to laboratory personnel of potentially infectious agents. Accordingly, there is a need for improved vessels for performing micro-fluidic assays.

SUMMARY OF THE INVENTION

The present invention involves the use of cartridges, which contain or are adapted to contain reaction fluids or by-products, to interface to a micro-fluidic chip which provides flexibility and ease of use for DNA analysis tests and other assays performed within the micro-fluidic chip. The cartridge, which contains the DNA sample and may also include buffers and/or one or more of the reagents to be used in the assay, may also include a waste containment chamber which enables a "closed" micro-fluidic system, whereby the DNA sample and other reaction products are returned to the same sample-containing cartridge, thereby eliminating the need for separate biohazardous waste management. The introduction of patient samples into micro-fluidic channels (or micro-channels) via a cartridge and introduction of assay-specific probes/primers into each sample droplet ensures no sample-to-sample carryover between patients while maintaining the advantage of in-line, serial PCR assay processing.

Aspects of the present invention are embodied in an assembly for performing micro-fluidic assays which includes a micro-fluidic chip and a fluid cartridge. The micro-fluidic chip has a top side and a bottom side and includes one or more access ports formed in the top side and at least one micro-channel extending from an associated access port through at least a portion of micro-fluidic chip. Each access port communicates with an associated micro-channel, such that fluid dispensed into the access port will flow into the associated micro-channel. The fluid cartridge has one or more internal chambers for containing fluids and a fluid nozzle associated with each internal chamber for dispensing fluid from the associated chamber or transmitting fluid into the associated internal chamber. Each fluid nozzle is configured to be coupled to an access port of the micro-fluidic chip to thereby dispense fluid from the associated internal chamber into the access port with which the nozzle is coupled or to transmit fluid from the access port with which the nozzle is coupled into the associated internal chamber.

In other embodiments, a cartridge device configured to interface with a micro-fluidic chip is provided wherein the cartridge device includes a delivery chamber and a recovery chamber. The delivery chamber is in fluid communication with a delivery port and is configured to contain a reaction fluid. The delivery port is configured to interface with a micro-fluidic chip. The recovery chamber is in fluid communication with a recovery port and is configured to receive waste materials from the micro-fluidic chip. The recovery port also is configured to interface with the micro-fluidic chip.

In still other embodiments, a cartridge device configured to interface with a micro-fluidic chip is provided which comprises a reagent delivery chamber connected to a reagent delivery port, a buffer delivery chamber connected to buffer delivery port, a sample delivery chamber connected to a sample delivery port, a waste recovery chamber connected to a waste recovery port, wherein the reagent delivery port, the buffer delivery port, the sample delivery port and the waste recovery port are configured to interface with the micro-fluidic chip. In this embodiment, the micro-fluidic chip includes one or more micro-channels through which one or more of the reagent, buffer and/or sample flows from the reagent delivery chamber, buffer delivery chamber and/or sample delivery chamber and into said waste recovery chamber.

Other aspects of the present invention, including the methods of operation and the function and interrelation of the elements of structure, will become more apparent upon consideration of the following description and the appended claims, with reference to the accompanying drawings, all of which form a part of this disclosure, wherein like reference numerals designate corresponding parts in the various figures.

DETAILED DESCRIPTION OF THE INVENTION

Figure 1A:
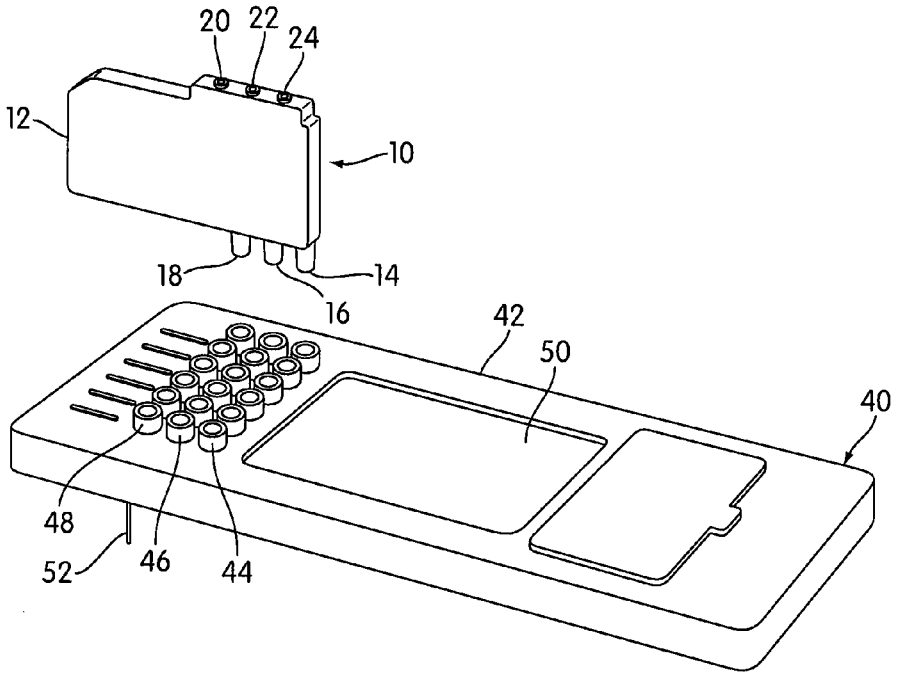
FIG. 1*a* is a perspective view of an embodiment of a micro-fluidic chip and cartridge embodying aspects of the present invention, with the cartridge shown separated from the micro-fluidic chip.
Figure 1B:
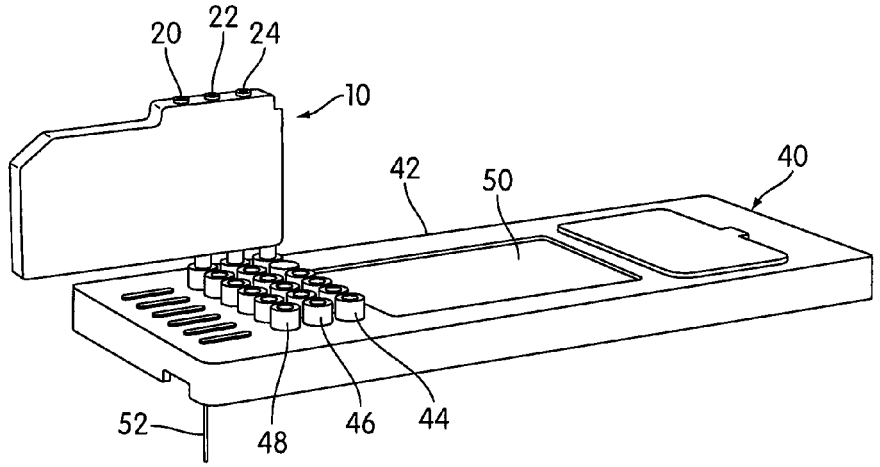
FIG. 1*b* is a perspective view of the micro-fluidic chip and cartridge shown in FIG. 1*a*, with the cartridge shown coupled to the micro-fluidic chip.

A first embodiment of a micro-fluidic chip and reagent cartridge configuration embodying aspects of the present invention is shown in FIGS. 1*a* and 1*b*. The configuration includes a cartridge 10 coupled to a micro-fluidic chip 40. The cartridge 10 and micro-fluidic chip 40 can be used in a system for performing an assay, such as in-line, real-time PCR, such as that described in U.S. application Ser. No. 11/505,358, incorporated herein by reference.

The cartridge 10 includes a body portion 12 with a plurality of nozzles, or outlet ports, 14, 16, 18 projecting therefrom. The illustrated embodiment is not intended to be limiting; the cartridge may have more or less than three nozzles as illustrated. Within the body portion 12, cartridge 10 includes internal chambers (not shown) in communication with corresponding nozzles, and such chambers may contain various fluids, for delivery to or removal from corresponding micro-channels within the micro-fluidic chip 40. Such fluids may include, for example, sample DNA material, buffers or reagents, including assay-specific reagents, and reaction waste products or other reaction fluids and/or by-products. Cartridge 10 may further include input ports, such as ports 20, 22, in communication with associated internal chambers for injecting fluids into the chambers. Such ports preferably include a cap for closing off the port after the fluid has been injected into the cartridge. The cap preferably includes some type of hydrophobic venting which prevents fluid from exiting the chamber through the capped port but allows venting for equalizing pressure between the atmospheric ambient pressure and the internal chamber pressure when fluid is being drawn out of the chamber. Cartridge 10 may also include a vacuum port 24 for connecting thereto a source of negative pressure (i.e., vacuum) for drawing fluids, for example, reaction waste products, through one or more of the nozzles 14, 16, or 18 into a waste chamber that is in communication with the vacuum port 24.

In one embodiment, the cartridge 10 is injection molded from a suitable, preferably inert, material, such as polypropylene, polycarbonate, or polystyrene. The cartridge 10 may also include internal design features for fluid containment (i.e., the chambers), fluid delivery, pressure control, and sample preparation (not shown). The cartridge may be constructed from other suitable materials as well.

Fluid capacity of each of the internal chambers may be between 20 μL and 5 mL and is preferably between 50 μL and 1000 μL and most preferably between 100 μL and 500 μL. Of course, other chamber volumes may also be used. A waste compartment, if incorporated into the cartridge design, may have a capacity of up to approximately 5 mL or more.

Micro-fluidic chip 40 includes a body 42 with rows of access ports, such as, for example, access ports 44, 46, and 48. Micro-channels in communication with the access ports 44, 46, 48 extend through the micro-fluidic chip 40. Micro-fluidic chip 40 includes a micro-channel portion 50 in which the micro-channels are formed and which, as will be described in more detail below, provides a location at which various assay-related operations are performed on materials flowing within the micro-channels. The micro-channel portion 50 can be made of any suitable material such as glass or plastic. An example of a micro-channel portion is disclosed in commonly assigned, co-pending U.S. application Ser. No. 11/505,358, incorporated herein by reference.

The cartridge 10 is coupled to the micro-fluidic chip 40 by connecting nozzles 14, 16, 18, with a column of access ports from rows 44, 46, and 48. The connection between a nozzle and an access port may be by way of a friction fit between each nozzle 14, 16, 18 inserted into a corresponding access port 44, 46, 48. Alternatively, the connection may be a luer lock connection or some other type of one-way locking connection, which allows the cartridge to be attached to the micro-fluidic chip, but, once attached, the cartridge cannot be removed from the micro-fluidic chip.

Figure 2A:
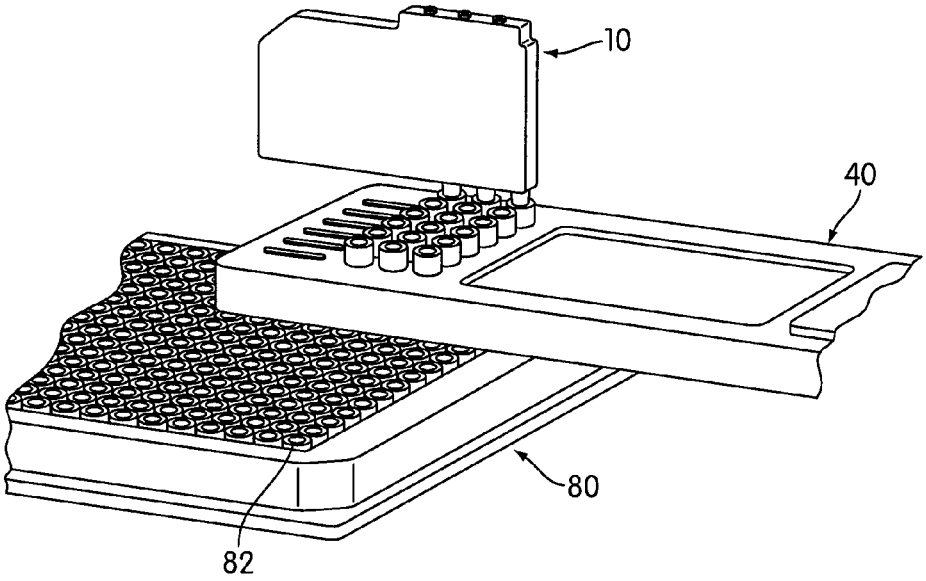
FIG. 2*a* is a perspective view of the micro-fluidic chip and cartridge assembly shown in FIG. 1*b*, with the assembly operatively positioned above a micro-well plate.
Figure 2B:
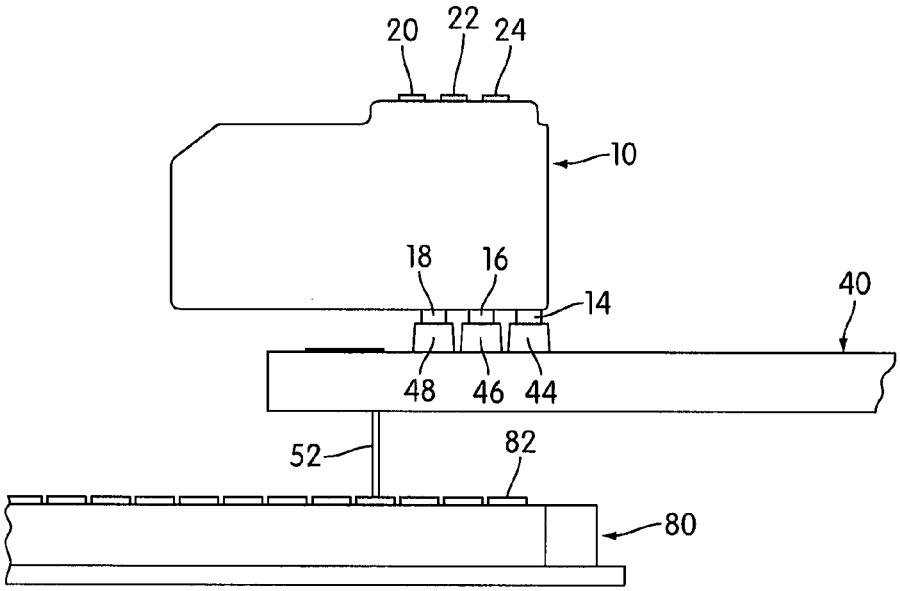
FIG. 2*b* is a side view of the micro-fluidic chip and cartridge assembly shown in FIG. 1*b*, with the assembly operatively positioned above a micro-well plate.

Micro-fluidic chip 40 may include a sipper tube 52 for drawing fluids (e.g., reagents) from an external container. As shown in FIGS. 2*a* and 2*b*, the micro-fluidic chip 40 and cartridge 10 configuration may be positioned above a microwell plate 80 having a plurality of individual wells 82. The micro-fluidic chip 40 and microwell plate 80 are moved with respect to each other (e.g., by a robotic device under computer control moving the micro-fluidic chip 40 and/or the microwell plate 80), thereby placing the sipper tube 52 extending below the micro-fluidic chip in a selected one of the wells 82 to draw the contents of that well into the sipper tube 52 and thus into the micro-fluidic chip 40.

Figure 3:
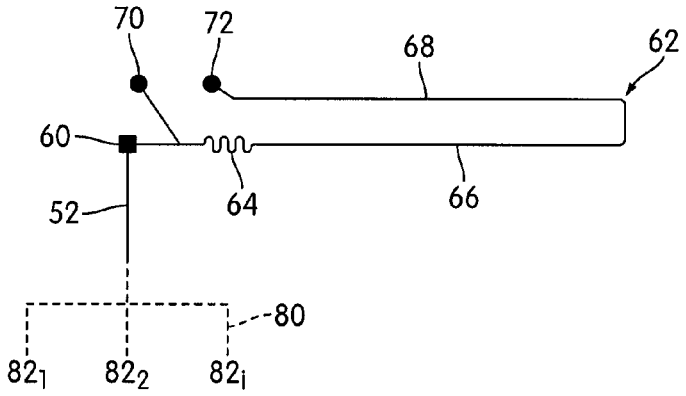
FIG. 3 is a schematic representation of a micro-channel and sipper tube of the micro-fluidic chip, with the sipper tube engaging wells of a micro-well plate.

FIG. 3 schematically illustrates a micro-channel 62 formed in the micro-fluidic chip 40. Micro-channel 62 includes an input port 70, which may correspond with an access port in row 48 or row 46 (or both) of the micro-fluidic chip 40, through which fluid from the cartridge 10 is injected into the micro-channel. In this embodiment, micro-channel 62 also includes an exit (or waste) port 72 which corresponds with an access port in row 44 of the micro-fluidic chip 40 and through which material from the micro-channel 62 is injected into the cartridge 10. Sipper tube 52 is coupled to the micro-channel 62 by way of a junction 60. In one embodiment, one micro-channel 62 is associated with each column of access ports within the rows 44, 46, 48 of access ports of micro-fluidic chip 40. Accordingly, in the embodiment shown in FIG. 1*a*, micro-fluidic chip 40 would include six micro-channels, one associated with each of the six columns of access ports.

In one embodiment having a single sipper tube 52, the sipper tube 52 is coupled to each of the micro-channels 62 by way of a junction 60, so that material drawn into the micro-fluidic chip 40 through the sipper tube 52 is distributed to each of the micro-channels contained within the micro-fluidic chip 40. As represented via dashed lines 80 in FIG. 3, the micro-fluidic chip 40 and microwell plate 80 are moved with respect to each other such that the sipper tube 52 can be placed in any one of the multiple wells 821, 822, 82; of the microwell plate 80.

In one embodiment, micro-channels 62 include a mixing section 64 for mixing materials introduced into the micro-channels 62 via the port 70 and sipper tube 52. Mixing section 64 may comprise a serpentine section of micro-channel or another known means for mixing the contents of the micro-channel. In other embodiments, the micro-channels 62 do not include a mixing section.

Furthermore, micro-channel 62 also includes an in-line PCR section 66 and an analysis section 68, located within micro-channel portion 50 of the micro-fluidic chip 40. Analysis section 68 may be provided for performing optical analysis of the contents of the micro-channel, such as detecting fluorescence of dyes added to the reaction materials, or other analysis, such as high resolution thermal melting analysis (HRTm). Such in-line PCR and micro-fluidic analysis is described in U.S. application Ser. No. 11/505,358, incorporation herein by reference. In one embodiment, micro-channel 62 makes a U-turn within the micro-fluidic chip 40, thus returning to the cartridge 10 so that at the conclusion of the in-line PCR and analysis the reaction products can be injected through the exit port 72 into a waste chamber within the cartridge 10. In other embodiments, other configurations for the micro-channel may be used as well.

The configuration of the present invention can be used for performing multiple sequential assays whereby discrete assays are performed within droplets of DNA or other sample material contained within the micro-channels. The sequentially arranged droplets may contain different PCR primers, or other assay-specific reagents, and may be separated from one another by droplets of non-reacting materials, which are known as flow markers. Such techniques for performing multiple discrete assays within a single micro-channel are also described in commonly-assigned co-pending application Ser. No. 11/505,358.

Figure 4:
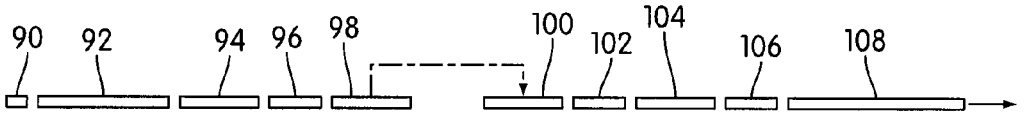
FIG. 4 is a schematic representation of the reaction fluids contained within a micro-channel during the performance of a micro-fluidic assay within the micro-channel.

FIG. 4 schematically illustrates the contents of a micro-channel in which a plurality of discrete assays are performed within discrete droplets of the DNA or other sample material in accordance with one embodiment. Referring to FIG. 4, and moving from right to left within the figure for fluids that are moving from left to right in the micro-channel, reference number 108 represents a priming fluid which is initially injected into the micro-channel so as to prime the micro-channel. Following the addition of priming fluid, a droplet, or bolus, 104 containing a control sample (e.g., containing a sample containing known DNA and/or a known DNA concentration) mixed with a PCR primer is injected into the micro-channel. Control droplet 104 is separated from the priming fluid 108 by a droplet of flow marker fluid 106. Flow marker 106 may comprise a non-reacting fluid, such as, for example, a buffer solution. Reference numbers 100 and 98 represent the first sample droplet and the nth sample droplet, respectively. Each sample droplet will typically have a volume about 8 nanoliters, and may have a volume of 2-50 nanoliters, and comprises an amount of DNA or other sample material combined with a particular PCR primer or other assay-specific reagent for performing and analyzing the results of an assay within each droplet. Each of the droplets 98-100 is separated from one another by a flow marker. As illustrated in FIG. 4, control droplet 104 is separated from sample droplet 100 by a flow marker 102. Reference number 94 indicates a second control droplet comprising a second control sample combined with a PCR primer, or other assay-specific reagents. Control droplet 94 is separated from the nth test droplet 98 by a flow maker 96.

FIG. 4 shows only two control droplets 104, 94 positioned, respectively, before and after, the test droplets 98-100. But it should be understood that more or less than two control droplets may be used, and the control droplets may be interspersed among the test droplets, separated from test droplets by flow markers. Also, FIG. 4 shows the droplets arranged in a straight line, but the micro-channel may be non-straight and may, for example, form a U-turn as shown in FIG. 3.

Reference number 92 represents a flush solution that is passed through the micro-channel to flush the contents out of the micro-channel. Reference number 90 represents final pumping of a fluid through the micro-channel to force the contents of the micro-channel into a waste container. Note that in FIG. 4, each of the blocks is shown separated from adjacent blocks for clarity. In practice, however, there is no gap separating various droplets of flow markers and sample droplets; the flow through the micro-channel is typically substantially continuous.

Figure 5:
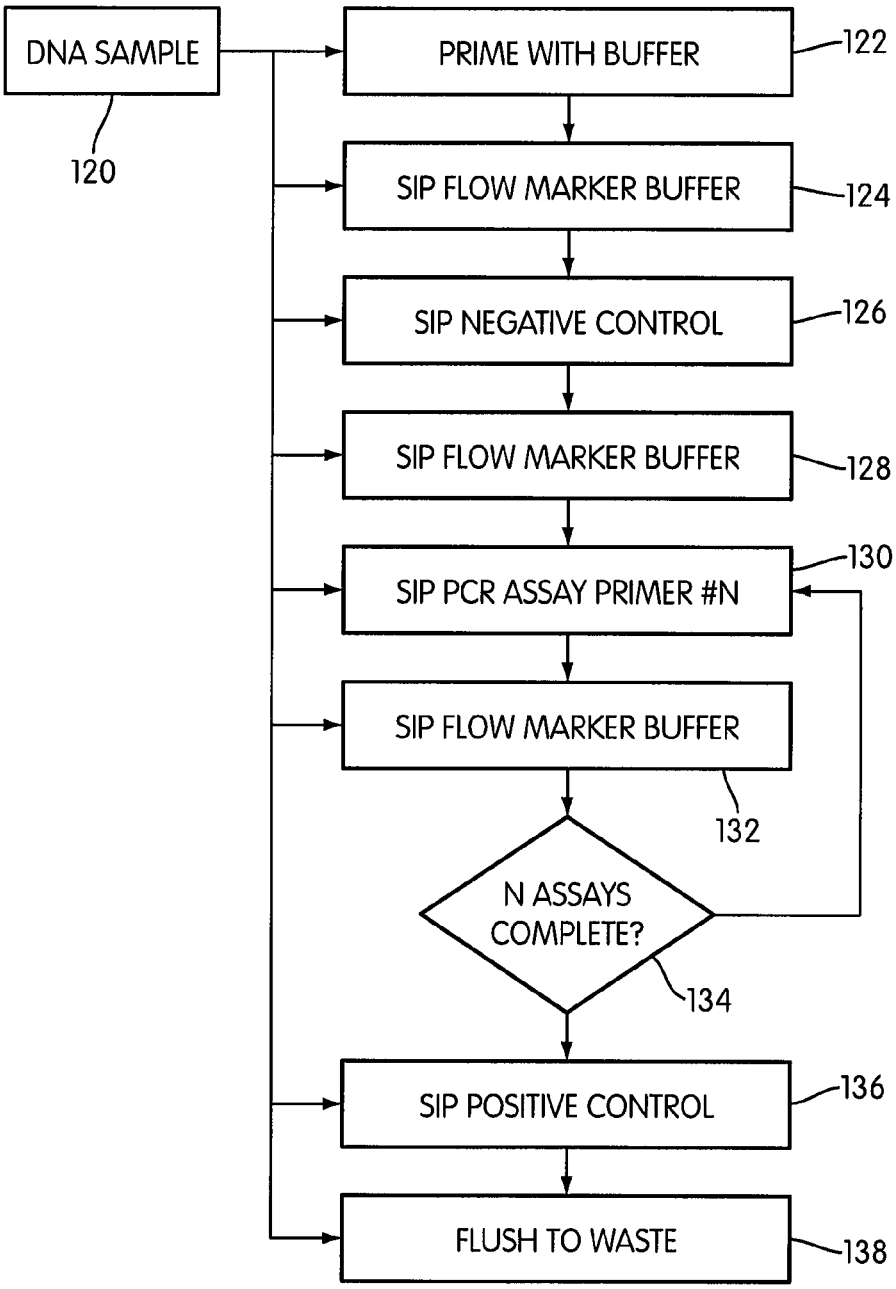
FIG. 5 is a flow chart illustrating steps performed during a micro-fluidic assay performed with a micro-fluidic chip and cartridge assembly operatively arranged with a micro-well plate as shown in FIGS. 2*a* and 2*b;*

The timing steps for the in-line assay according to one embodiment are shown in FIG. 5. The implementation of such timing steps is typically effected under the control of a system computer. In step 122, the micro-channel is primed with a buffer solution. The buffer solution may be contained within a compartment within the cartridge 10, or it may be sipped through the sipper tube 52 from one of the wells 82 of the microwell plate 80. Meanwhile, sample material such as DNA material is continuously injected from a sample compartment within the cartridge 10 into the micro-channel, as represented by step 120 connected by arrows to all other steps. After the priming step 122, an amount of flow marker buffer material is sipped into the micro-channel in step 124. Next, a negative control sample and PCR primer are sipped into the micro-channel in step 126 to form a control test droplet. Another amount of flow marker buffer solution is sipped into the micro-channel at step 128. As noted above, the DNA sample is continuously injected into the micro-channel, as indicated at step 120, throughout the process. At step 130, the PCR assay primer, or other assay specific reagent, is sipped from a well 82; in the micro-well plate 80 by the sipper tube 52 and into the micro-channel and mixed with a portion of the continuously-flowing DNA sample, thereby forming a test droplet. At step 132, flow marker buffer is sipped into the micro-channel—and mixed with a portion of the continuously-flowing DNA sample—thereby forming a flow marker droplet to separate the test droplet formed in the previous step from a subsequent test droplet. At step 134, a logic step is performed to determine whether all of the assays to be performed on the sample material have been completed. If not, the process returns to step 130, and another amount of PCR assay primer, or other assay specific reagent, is sipped into the micro-channel and mixed with a portion of the continuously-flowing DNA sample, thereby forming a subsequent test droplet. Next, step 132 is repeated to form another flow marker droplet. When all the assays have been completed, a positive control sample and PCR primer are sipped into the micro-channel in step 136 to form a second control test droplet. As noted above, however, it is not necessarily required that the control droplets precede and follow the test droplets. And, at step 138, the contents of the micro-channel are flushed to a waste container.

Figure 6:
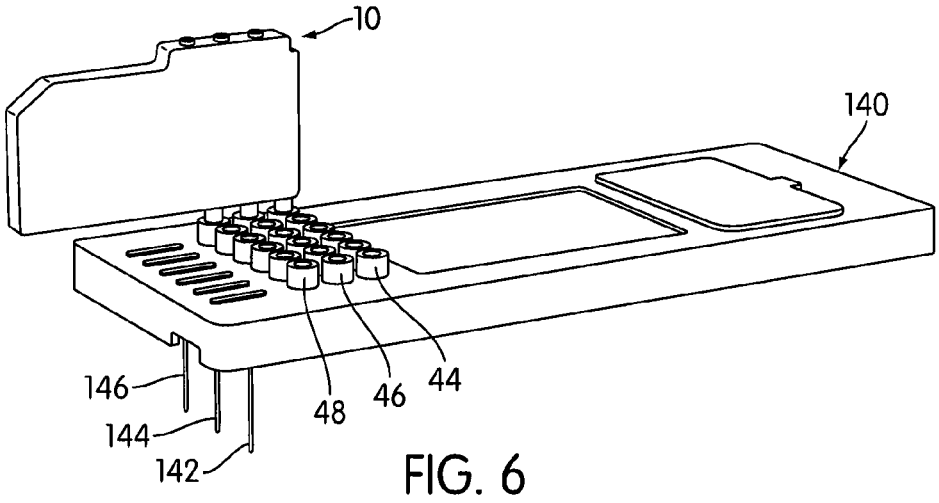
FIG. 6 is a perspective view of an alternative embodiment of a micro-fluidic chip and cartridge embodying aspects of the present invention, with the cartridge shown coupled to the micro-fluidic chip.

FIG. 6 shows an arrangement in which a cartridge 10 is connected to a micro-fluidic chip 140 which has three sipper tubes 142, 144, 146. In this arrangement, each column of input ports in rows 44, 46, 48 would be coupled to three different micro-channels, and each of the micro-channels would be connected to one of the three sipper tubes 142, 144 and 146. Accordingly, in the arrangement shown in FIG. 6, the micro-fluidic chip 140 would include 18 micro-channels, three micro-channels for each of the six columns of access ports. This arrangement allows increased parallel processing throughput. For example, in a pharmacogenomic application, a single DNA sample can be processed with several PCR primer sets in parallel. This parallel configuration could also be designed with four or more sipper tubes.

Figure 7:
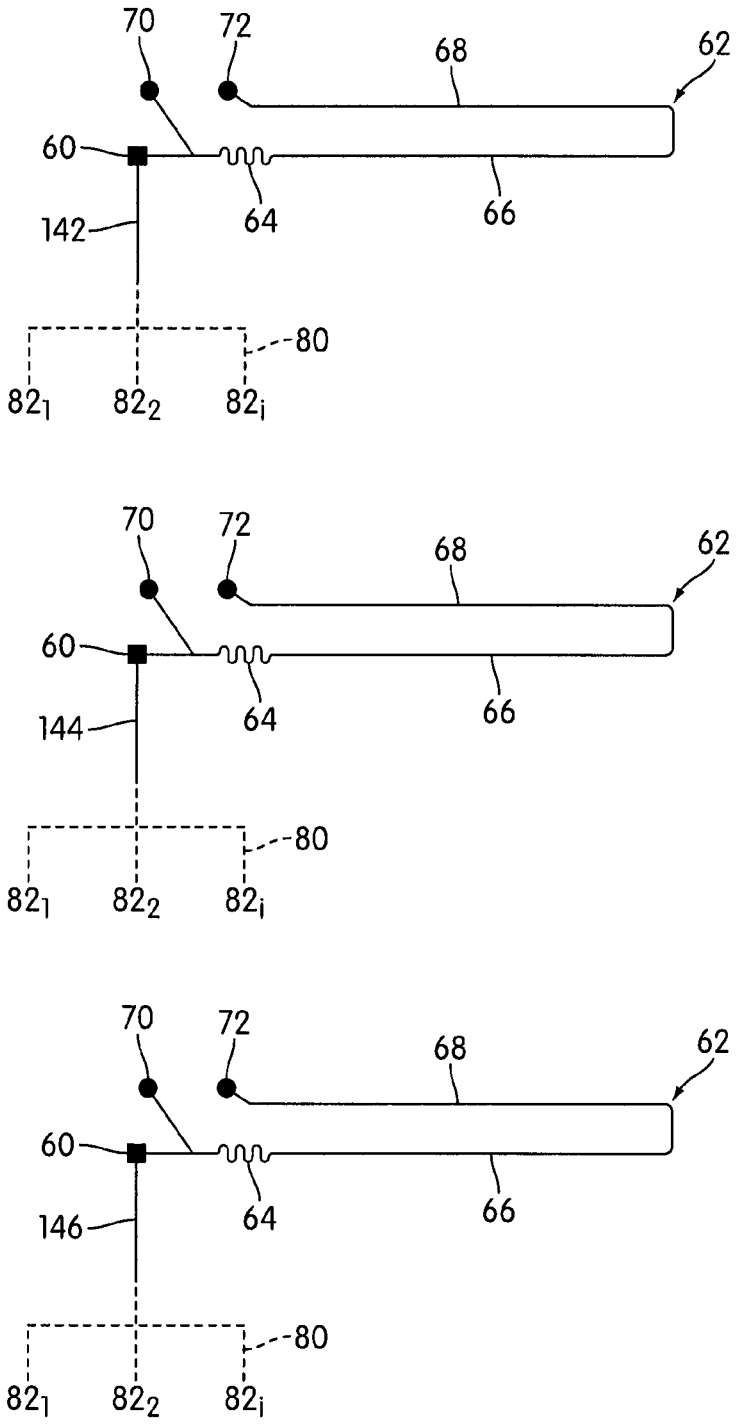
FIG. 7 is a schematic representation of a micro-channel and multisipper chip configuration.

FIG. 7 schematically illustrates micro-channels 62 formed in the micro-fluidic chip 40 in the multi-sipper configuration of FIG. 6. Each of the micro-channels 62 is preferably configured substantially as described above in connection with FIG. 3. However, in this embodiment, each column of input ports in rows 44, 46, 48 would be coupled to three different micro-channels, and each of the micro-channels would be connected to one of the three sipper tubes 142, 144 and 146.

Figure 8:
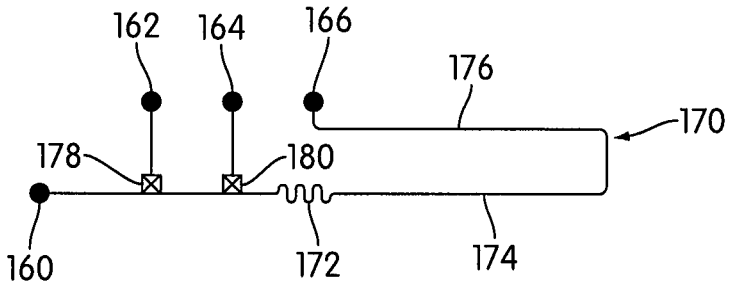
FIG. 8 is a is a schematic representation of a micro-channel of a sipper-less micro-fluidic chip for an alternative embodiment of a micro-fluidic chip and cartridge embodying aspects of the present invention.
Figure 9:
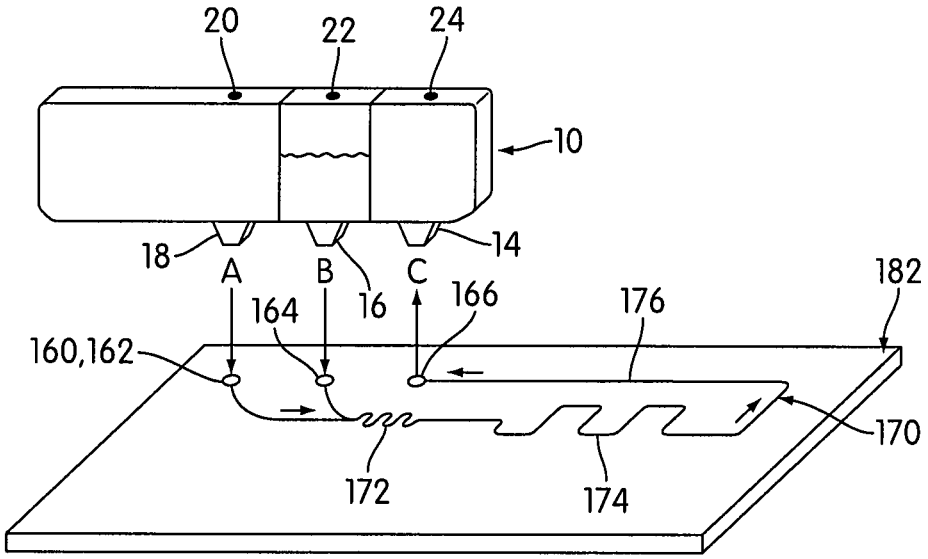
FIG. 9 is a schematic representation of an alternative embodiment of a sipper-less micro-fluidic chip and cartridge embodying aspects of the present invention.

FIGS. 8 and 9 show an alternative arrangement of the invention which does not include a sipper tube. In such a sipper-less arrangement, all of the materials, including buffers, DNA sample material, and assay specific reagents, maybe self-contained within the cartridge. In this design, the reagent cartridge provides all of the functions: DNA sample preparation, reagent supply, buffer/reagent supply, and waste containment.

FIGS. 8 and 9 are schematic representations of a micro-channel 170 of a micro-fluidic chip 182 that does not include a sipper tube. As shown in FIG. 8, micro-channel 170 includes a buffer input port 160 through which a continuous stream of buffer solution is injected into the micro-channel 170. DNA sample material, or other sample material, is injected into the micro-channel 170 through the DNA input port 162, and PCR primer, or other assay-specific reagent, is injected into the micro-channel 170 through the reagent input port 164. Reaction waste material exits the micro-channel 170 and enters a waste compartment of a cartridge 10 through the exit port 166. Micro-channel 170 may include a mixing section 172, an in-line PCR section 174, and an analysis area 176. The injection of substances through the input ports 162 and 164 is controlled by injection port valves 178 and 180, which may be, for example, piezoelectric or bubble jet type valves. The purpose of the valves 178 and 180 is to inject sample material and assay specific reagents at selected intervals into the continuous stream of buffer solution to generate discrete test droplets, e.g., as shown in FIG. 4.

As shown in FIG. 9, nozzle 18 of cartridge 10 communicates with port A of the micro-channel 170. FIG. 9 illustrates a configuration in which input ports 160 and 162 shown in FIG. 8 are effectively combined, so that a mixture of DNA sample material and buffer solution contained within the cartridge 10 is injected into the micro-channel 170 through port A. Alternatively, buffer solution can be injected at a discrete port, as shown in FIG. 8, from a fourth nozzle and associated compartment of the cartridge (not shown) or from an external source of buffer solution. Nozzle 16 of the cartridge 10 communicates with input port B, which corresponds to input port 164 of FIG. 8. Nozzle 14 of the cartridge 10 communicates with port C of the micro-fluidic chip 182 which corresponds with exit port 166 shown in FIG. 9. To draw the DNA sample material and reagents, as well as buffer solution, through the micro-channel 170 and into the waste compartment of cartridge 10, a vacuum source is connected to the cartridge 10 at vacuum port 24.

Reaction fluids, such as buffer and reagents, may be factory-loaded into the cartridge, accompanied by information such as lot numbers and expiration dates, preferably provided on the cartridge itself. DNA sample material can then be added to the appropriate chamber by the user prior to use of the cartridge. Alternatively, empty cartridges can be provided and such cartridges can be filled with the desired assay fluids (e.g., sample material, buffers, reagents) by laboratory personnel prior to attaching the cartridge to a micro-fluidic chip.

Figure 10:
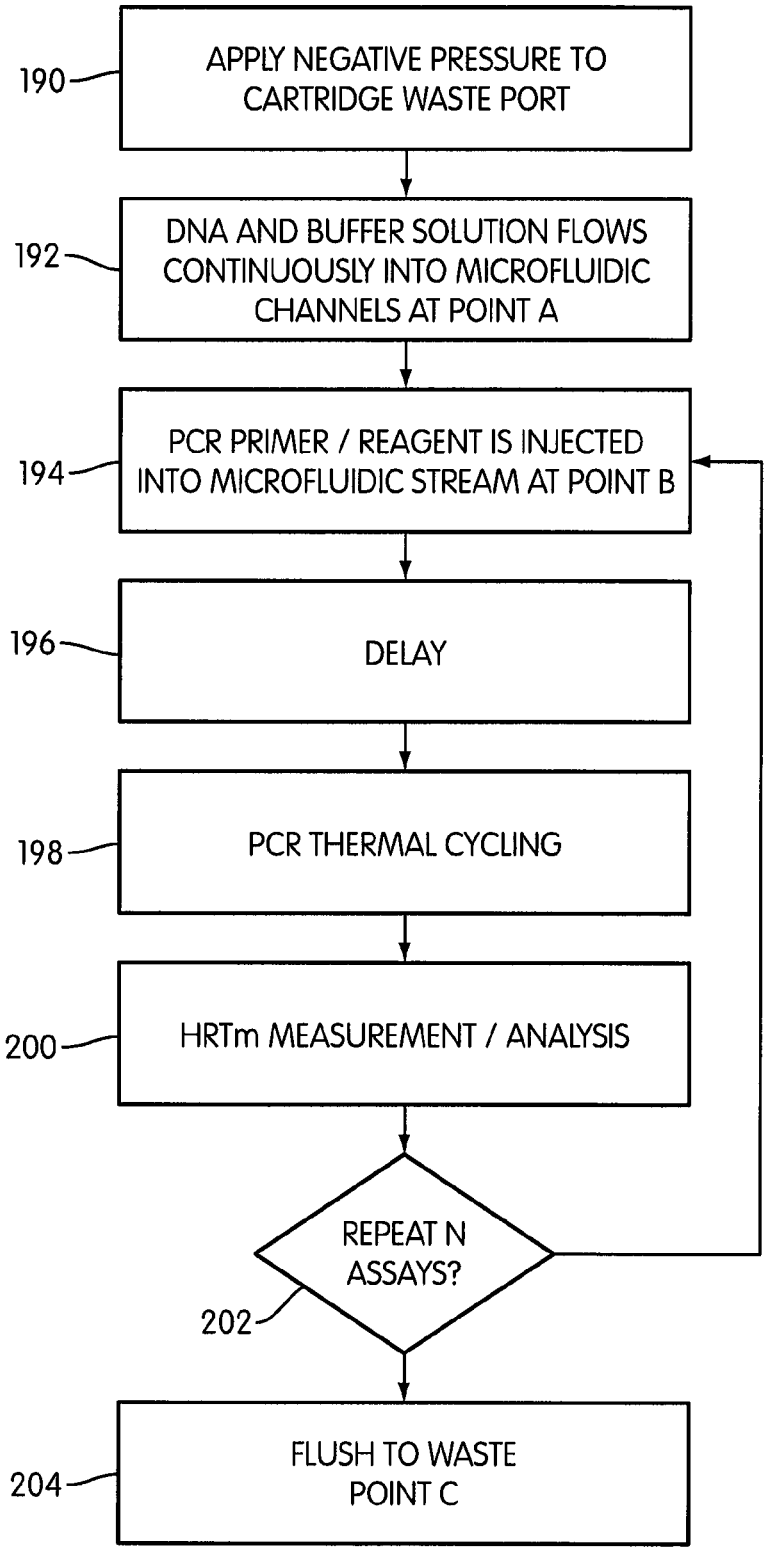
FIG. 10 is a flow chart illustrating steps performed during a micro-fluidic assay performed with a micro-fluidic chip and cartridge assembly as shown in FIG. 8 or 9.

FIG. 10 illustrates a timing sequence that is implemented using the sipper-less cartridge and micro-fluidic chip configuration as shown in FIG. 9. In step 190, a negative pressure is applied to the cartridge waste port (i.e., vacuum port 24) to create a negative pressure within micro-channel 170. In step 192, DNA and buffer solution flows continuously into the micro-channels at point A. In step 194, PCR primer/reagent, or other assay specific reagent, is injected into the micro-fluidic stream at point B (i.e., port 164). In step 196, the input of reaction fluids into the micro-channel is delayed. In step 198, PCR thermal cycling (or other assay process) is performed on the material within the micro-channel at section 174 of the micro-channel 170. At step 200, HRTm measurement, or other analysis, is performed on the contents of the micro-channel at section 176 of the micro-channel 170. At step 202, a determination is made as to whether additional assays need to be performed. If further repeat assays need to be performed, the process returns to step 194, and additional PCR primer/reagent is injected into the stream at point B followed by a delay (step 196), PCR thermal cycling (step 198), and measurement or analysis (step 200). When all desired assays have been completed, the micro-channel 170 is flushed to the waste compartment at port C (exit port 164) in step 204. The timing sequence illustrated in FIG. 10 would be similar for the timing sequence that is implemented using the sipper-less cartridge and micro-fluidic chip configuration as shown in FIG. 8, except that the DNA sample material is injected into the micro-channel 170 through the DNA input port 162, and PCR primer is injected into the micro-channel 170 through the reagent input port 164.

Figure 11:
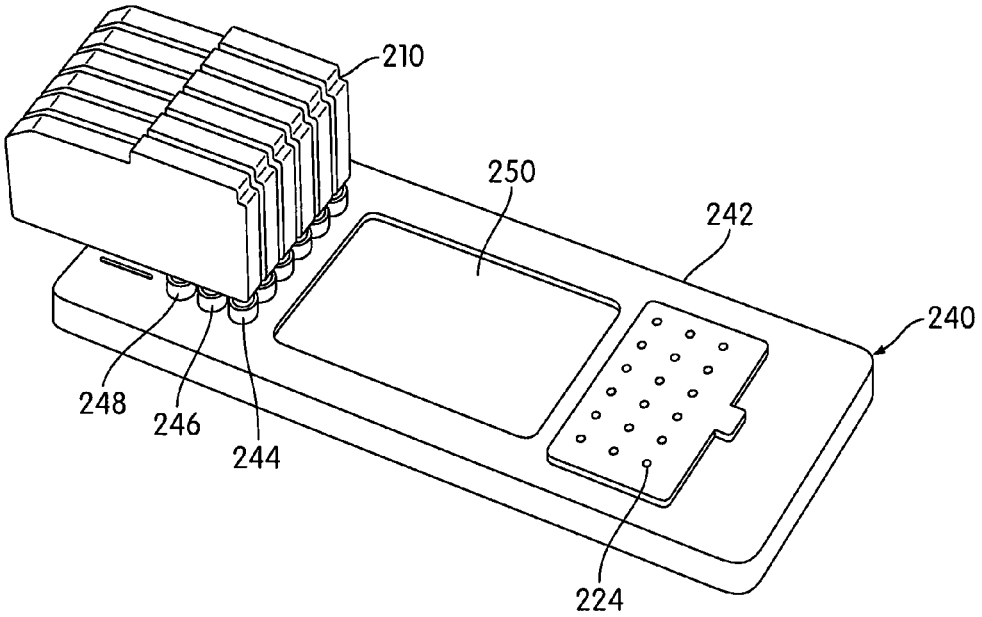
FIG. 11 is a perspective view of an alternative embodiment of a micro-fluidic chip and multiple cartridges embodying aspects of the present invention, with the cartridges shown coupled to the micro-fluidic chip.

FIG. 11 illustrates an alternative embodiment of the micro-fluidic chip indicated by reference number 240. Micro-fluidic chip 240 includes a body 242 and a micro-channel window 250 with three rows of access ports 244, 246, 248. Multiple cartridges 210 are coupled to the access ports 244, 246, 248. (Note that multiple cartridges can be coupled to the micro-fluidic chips of the previously described embodiments in a similar manner.) Micro-fluidic chip 240 differs from the previously-described micro-fluidic chips in that the micro-channels within micro-fluidic chip 240 do not make a U-turn and return to a waste port for transferring used reaction fluids from the micro-channel into a waste compartment of the cartridge 210. Instead, the micro-fluidic chip 240 includes vacuum ports 224 disposed on the body 242 on an opposite side of the window 250 from the access ports 244, 246, 248. There may be a dedicated vacuum port 224 for each micro-channel, or one or more vacuum ports may be coupled to two or more (or all) micro-channels.

In using the embodiment shown in FIG. 11, an external vacuum source (not shown) is connected to the ports 224 to draw fluids through the micro-channels of micro-fluidic chip 240, instead of attaching a vacuum port to the cartridge 210 for drawing materials into a waste compartment contained within the cartridge. Also in connection with this embodiment, the used reaction fluids from the micro-channels are transferred into a waste compartment in fluid communication with the micro-channels (not shown) which is not contained within cartridge 210.

While the present invention has been described and shown in considerable detail with disclosure to certain preferred embodiments, those skilled in the art will readily appreciate other embodiments of the present invention. Accordingly, the present invention is deemed to include all modifications and variations encompassed within the spirit and scope of the following appended claims.

We claim:

1. A system for performing microfluidic assays, the system comprising:

a microfluidic chip comprising a DNA amplification area and an analysis area in communication with at least a first access port and a second access port; and a cartridge device configured to removably interface with the micro-fluidic chip, the cartridge device comprising:

a delivery chamber in fluid communication with a delivery port, wherein said delivery chamber is configured to contain a reaction fluid and said delivery port is configured to removably interface with the first access port of the micro-fluidic chip; and a recovery chamber in fluid communication with a recovery port, wherein said recovery chamber is configured to receive waste materials from the second access port of said micro-fluidic chip and said recovery port is configured to removably interface with said micro-fluidic chip;

wherein the cartridge device delivers fluids to and removes fluids from the microfluidic chip, wherein a connection between the microfluidic chip and the cartridge device is limited to coupling the delivery port to the first access port and the recovery port to the second access port; and, wherein the DNA amplification area and the analysis area of the microfluidic chip are configured to support an amplification reaction and a subsequent analysis.

2. The system of claim 1, wherein the cartridge is disposable.

3. The system of claim 1, wherein said cartridge is removably interfaced with a micro-fluidic chip and the micro-fluidic chip incorporates a sipper tube to aspirate reagents into the chip.

4. A system for performing microfluidic assays, the system comprising:

a microfluidic chip comprising a DNA amplification area and an analysis area in communication with one or more access ports; and a cartridge device configured to removably interface with the micro-fluidic chip, the cartridge device comprising:

a reagent delivery chamber, wherein the reagent delivery chamber is connected to a reagent delivery port;

a buffer delivery chamber, wherein the buffer delivery chamber is connected to a buffer delivery port;

a sample delivery chamber, wherein the sample delivery chamber is connected to a sample delivery port;

a waste recovery chamber, wherein the waste recovery chamber is connected to a waste recovery port; and wherein said reagent delivery port, said buffer delivery port, said sample delivery port and said waste recovery port are configured to removably interface with the micro-fluidic chip to deliver fluids and remove fluids from the micro-fluidic chip, wherein a connection between the microfluidic chip and the cartridge device is limited to coupling the delivery ports and the recovery port to said one or more access ports; and, wherein, the DNA amplification area and the analysis area of the microfluidic chip are configured to support an amplification reaction and a subsequent analysis.

5. The system of claim 4, wherein the cartridge is disposable.

6. The system of claim 4, wherein said cartridge is interfaced with a micro-fluidic chip and the micro-fluidic chip incorporates a sipper tube to aspirate reagents into the chip.

7. The system of claim 4, wherein said cartridge is interfaced with a micro-fluidic chip and the micro-fluidic chip comprises one or more micro-channels through which one or more of a reagent, buffer and/or sample flows from said reagent delivery chamber, buffer delivery chamber and/or sample delivery chamber and into said waste recovery chamber.

8. The system of claim 1, further comprising a vacuum port in communication with at least one of said delivery chamber and said recovery chamber and configured to couple said cartridge device to a pressure source for generating pressure within said cartridge to move fluid out of said delivery chamber and/or into said recovery chamber.

9. The system of claim 4, further comprising a vacuum port in communication with at least one of said reagent delivery chamber, said buffer delivery chamber, said sample delivery chamber, and said waste recovery chamber and configured to couple said cartridge device to a pressure source for generating pressure within said cartridge to move fluid out of one or more of said reagent delivery chamber, said buffer delivery chamber, and said sample delivery chamber and/or into said waste recovery chamber.

10. The system of claim 1, wherein the delivery ports contain hydrophobic venting caps.

11. The system of claim 4, wherein the buffer, sample, and reagent delivery ports contain hydrophobic venting caps.

12. The system of claim 3, further comprising a robotic device under computer control to move the micro-fluidic chip relative to a microwell plate to draw reagents through the sipper tube placed into different wells of the microwell plate as the microfluidic chip moves.

13. The system of claim 6, further comprising a robotic device under computer control to move the micro-fluidic chip relative to a microwell plate to draw reagents through the sipper tube placed into different wells of the microwell plate as the microfluidic chip moves.

14. The system of claim 1, wherein the delivery chamber defines a closed volume to store the reaction fluid prior to attaching the cartridge to the micro-fluidic chip.

15. The system of claim 4, wherein each of the reagent delivery chamber, the sample delivery chamber, and the buffer delivery chamber defines a closed volume to store a reagent, sample, and buffer, respectively, prior to attaching the cartridge to the micro-fluidic chip.

* * * * *